US005896903A

United States Patent [19]

Chen et al.

[11] Patent Number: 5,896,903

[45] Date of Patent: Apr. 27, 1999

[54] METHOD OF FABRICATING BAMBOO SLATS FOR BAMBOO BLINDS

[76] Inventors: Feng-Yuan Chen, No. 28, Lane 59, Rose Rd., Hsin-Tien City, Taipei Hsien; Ming-Chi Cheng, No. 25, Ping-Ho Street, Yen-Pei Village, Yen-Pu Country, Pin-tung, both of Taiwan

[21] Appl. No.: 09/055,748

[22] Filed: Apr. 7, 1998

[51] Int. Cl.[6] ..... B27D 1/00; B27H 1/00

[52] U.S. Cl. ..... 144/350; 144/346; 144/348; 144/351; 144/352; 144/364; 144/367; 144/369; 144/380; 144/5; 144/3.1; 428/105; 428/106; 428/57; 428/378; 156/62.4; 156/250; 156/296

[58] Field of Search ..... 144/5, 345, 346, 144/349, 350, 351, 352, 361, 362, 364, 367, 369, 380; 156/62.4, 62.6, 250, 296; 426/105, 106, 107, 57, 114, 378

[56] References Cited

U.S. PATENT DOCUMENTS 5,441,787 8/1995 Fujii et al. ..... 144/358
5,505,238 4/1996 Fujii et al. ..... 144/348

*Primary Examiner*—W. Donald Bray
*Attorney, Agent, or Firm*—Rosenberg, Klein & Bilker

[57] ABSTRACT

A method of fabricating bamboo slats for bamboo blinds, including the steps of: i) cutting bamboo wood into bamboo strips subject to a predetermined length; ii) removing the skin and joints from both sides of the bamboo strips, then boiling the bamboo strips in a diluted hydrogen peroxide solution to prevent decay, and then polishing the bamboo strips after drying; iii) bonding the bamboo strips into a rectangular bamboo plate, then polishing the bamboo plate thus obtained; iv) splitting the polished bamboo plate thus obtained into raw bamboo slats subject to a predetermined thickness, then polishing the bamboo slats, and then coating the bamboo slats with a base coating and then with a face coating; v) punching two punch holes on the bamboo slats thus obtained for the insertion of a pull cord so that the finished bamboo slats thus obtained can be assembled with a pull cord into a bamboo blind.

10 Claims, 6 Drawing Sheets

METHOD OF FABRICATING BAMBOO SLATS FOR BAMBOO BLINDS

BACKGROUND OF THE INVENTION

The present invention relates to a method of fabricating bamboo slats for bamboo blinds. Finished bamboo slats are obtained by: cutting bamboo wood into strips, removing the skin and joints from the bamboo strips and boiling the bamboo strips to prevent decay, bonding the bamboo strips into a bamboo plate, splitting the bamboo strips into bamboo slats and coating the bamboo slats with a base coating and a face coating on the base coating, and then punching punch holes on the bamboo slats.

Conventionally, the slats for Venetian blinds are made from wooden material for the advantages of a fine touch and a good outer appearance. However, because forests are over-cultivated in recent years, it is difficult to obtain sufficient supply of wooden material, and the cost of wooden material has become very high. Furthermore, because the fiber structure of wooden material cannot bear high pressure, the wooden slats for a Venetian blind must have a certain thickness. Recently, polyvinyl chloride and aluminum are used for making slats for Venetian blinds. However, the fabrication of plastic or aluminum slats will cause pollution.

SUMMARY OF THE INVENTION

It is the main object of the present invention to provide a slat fabrication method which uses bamboo wood as material for making slats for Venetian blinds. According to the present invention, the bamboo slat fabrication method comprises the steps of: i) cutting bamboo wood into bamboo strips subject to a predetermined length; ii) removing the skin and joints from both sides of the bamboo strips, then boiling the bamboo strips in a diluted hydrogen peroxide solution to prevent decay, and then polishing the bamboo strips after drying; iii) bonding the bamboo strips into a rectangular bamboo plate, then polishing the bamboo plate thus obtained; iv) splitting the polished bamboo plate thus obtained into raw bamboo slats subject to a predetermined thickness, then polishing the bamboo slats, and then coating the bamboo slats with a base coating and then with a face coating; v) punching two punch holes on the bamboo slats thus obtained for the insertion of a pull cord so that the finished bamboo slats thus obtained can be assembled with a pull cord into a bamboo blind.

DETAILED DESCRIPTION OF THE PREFERRED EMBODIMENT

Figure 1:
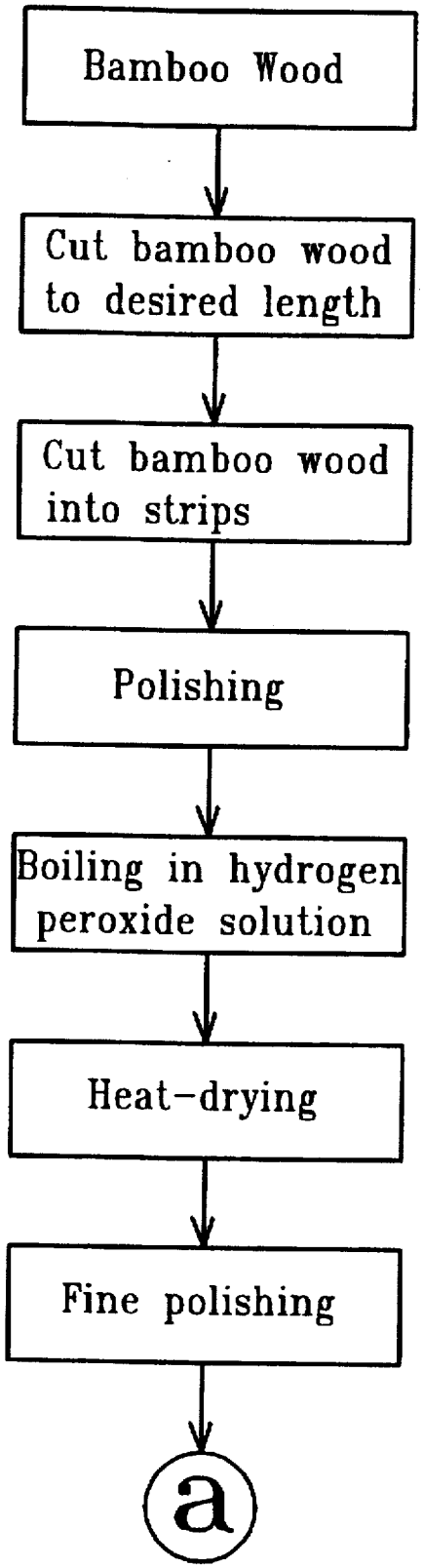
FIG. 1 is a bamboo slat fabrication block diagram according to the present invention (Part I).
Figure 2:
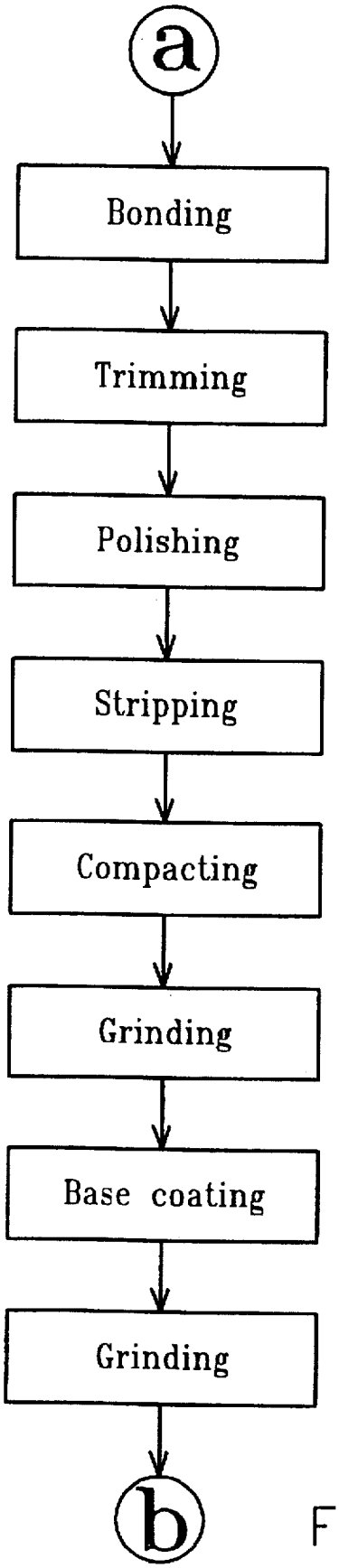
FIG. 2 is a bamboo slat fabrication block diagram according to the present invention (Part II).
Figure 3:
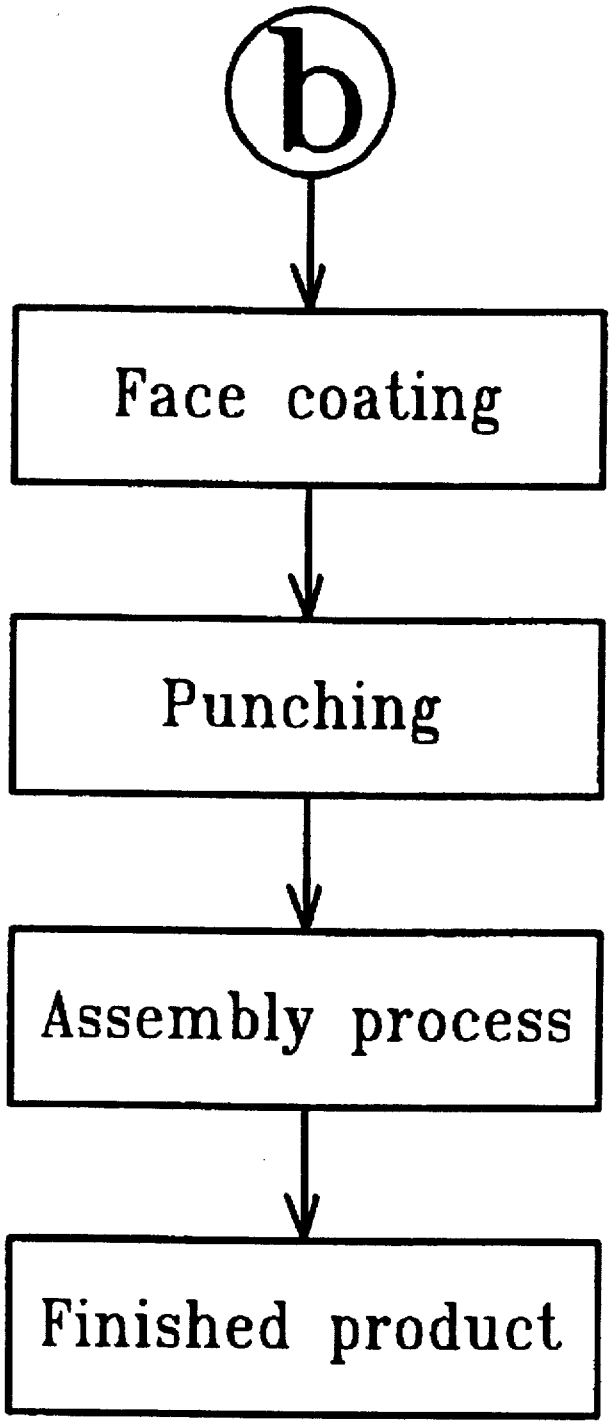
FIG. 3 is a bamboo slat fabrication block diagram according to the present invention (Part III).
Figure 4:
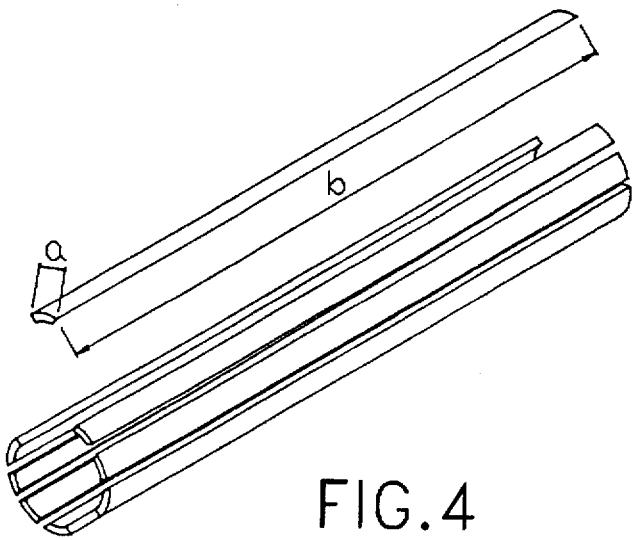
FIG. 4 shows a bamboo wood cut into bamboo strips according to the present invention.
Figure 5:
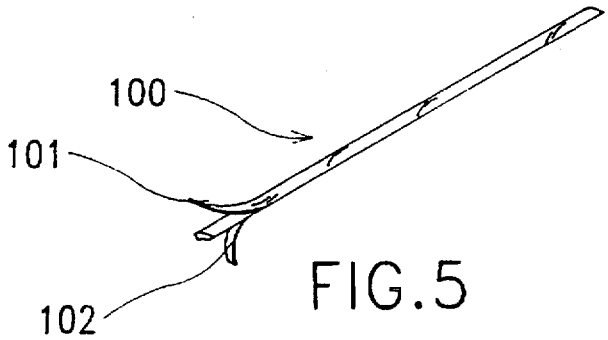
FIG. 5 shows the skin and joint removed from both sides of the bamboo strip according to the present invention.
Figure 6:
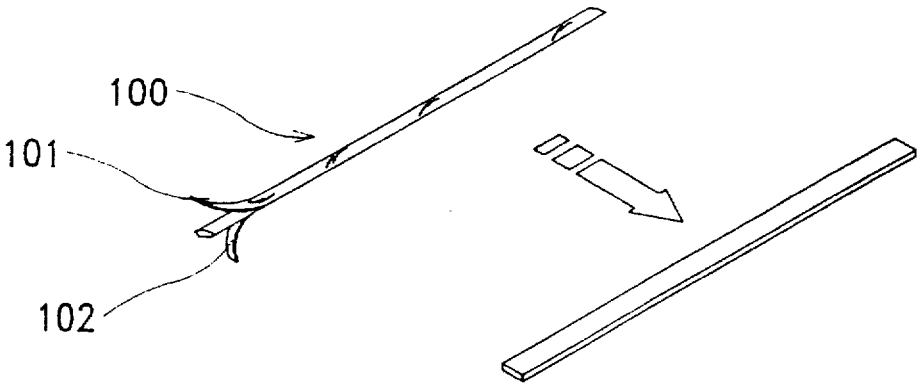
FIG. 6 shows the bamboo strip of FIG. 5 processed into a fine bamboo strip.
Figure 7:
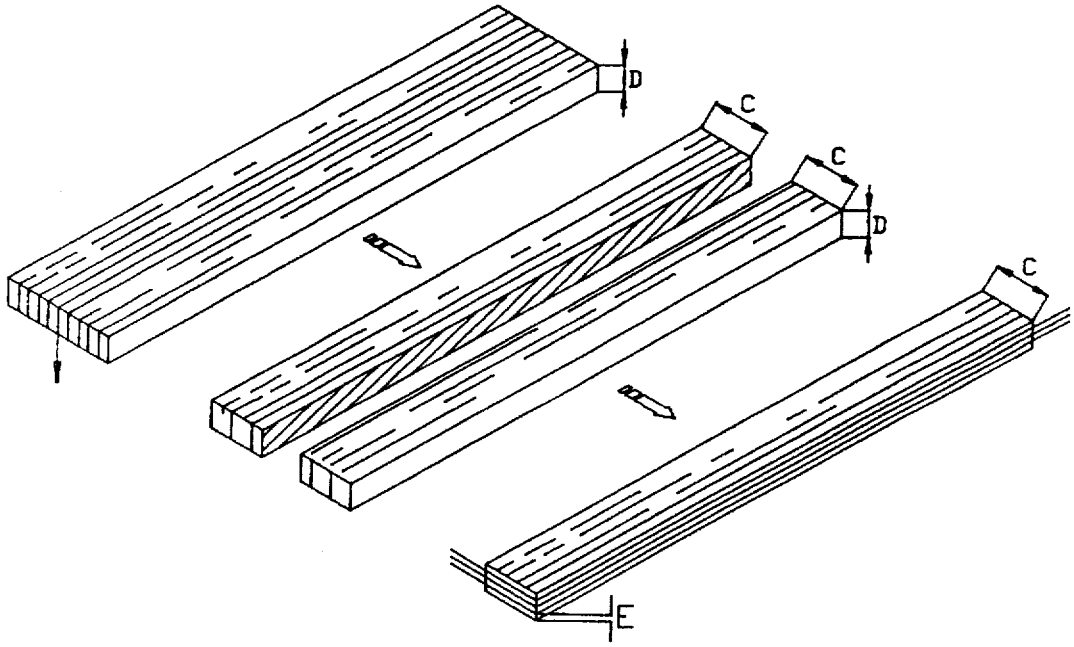
FIG. 7 shows the bamboo plate trimmed according to the present invention.
Figure 8:
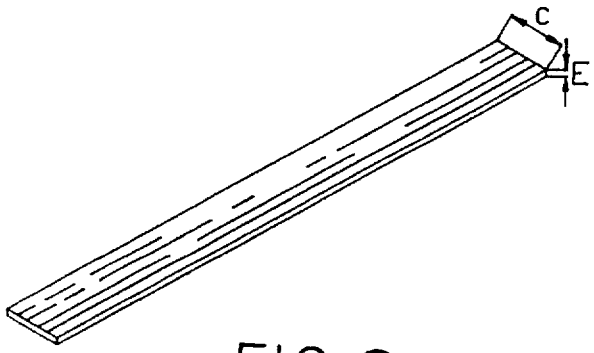
FIG. 8 shows a raw bamboo slat split from a bamboo plate according to the present invention.
Figure 9:
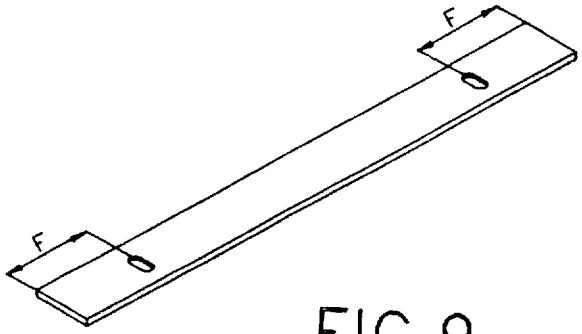
FIG. 9 shows a finished bamboo slat according to the present invention.

Referring to FIGS. 1, 2 and 3, a bamboo slat fabrication method in accordance with the present invention comprises the steps of:

1. selecting bamboo wood from a bamboo cane which has a diameter within about 3"~5" and a thickness within about 10 mm~26 mmm, and is cut from a bamboo tree of about 3–4 years old at an elevation 10 cm above the root of the bamboo tree, then cutting the selected bamboo wood to the desired length b, and then cutting the bamboo wood into bamboo strips 100 of width a within about 20 mm–30 mm (see FIGS. 4 and 5);

2. removing the skin 101 and joints 102 from both sides of the bamboo strips 100, then boiling the bamboo strips 100 in a diluted hydrogen peroxide solution for 8 hours to prevent decay, and then heat-drying the bamboo strips 100 at a heating temperature about within 50°~60° C. for about 48 hours, and then polishing the dried bamboo strips into fine bamboo strips (see FIG. 6);

3. coating the bamboo strips thus obtained with a bonding glue which is obtained by mixing acrylic powder with resin, then using a pneumatic press to bond the glue-coated bamboo strips, enabling the glue-coated bamboo strips to be bonded longitudinally side to side together into a rectangular bamboo plate of thickness D about 17~25 mm, width C about 28~110 mm (see FIG. 7), then trimming the peripheral edges of the rectangular bamboo plate, and then polishing the trimmed bamboo plate by a polishing wheel;

4. splitting the polished bamboo plate into raw bamboo slats of thickness E about 0.6 mm~2.7 mm by a splitter (see FIGS. 7 and 8), then compacting the raw bamboo slats by a pneumatic press, and then polishing the bamboo slats by a grinding wheel, and then coating the bamboo slats with a base coating obtained from a digestive fiber, surfacer and resin mixture, and then coating the base coating coated bamboo slats with a face coating obtained from a digestive fiber, resin, surfacer and organic solvent mixture (the hardness of the bamboo slats thus obtained is about within 2 H~4 H);

5. punching two punch holes on the bamboo slats thus obtained for the insertion of a pull cord (the distance F between one end edge of a bamboo slat and the adjacent punch hole is about 140 mm~150 mm; see FIG. 9).

Figure 10:
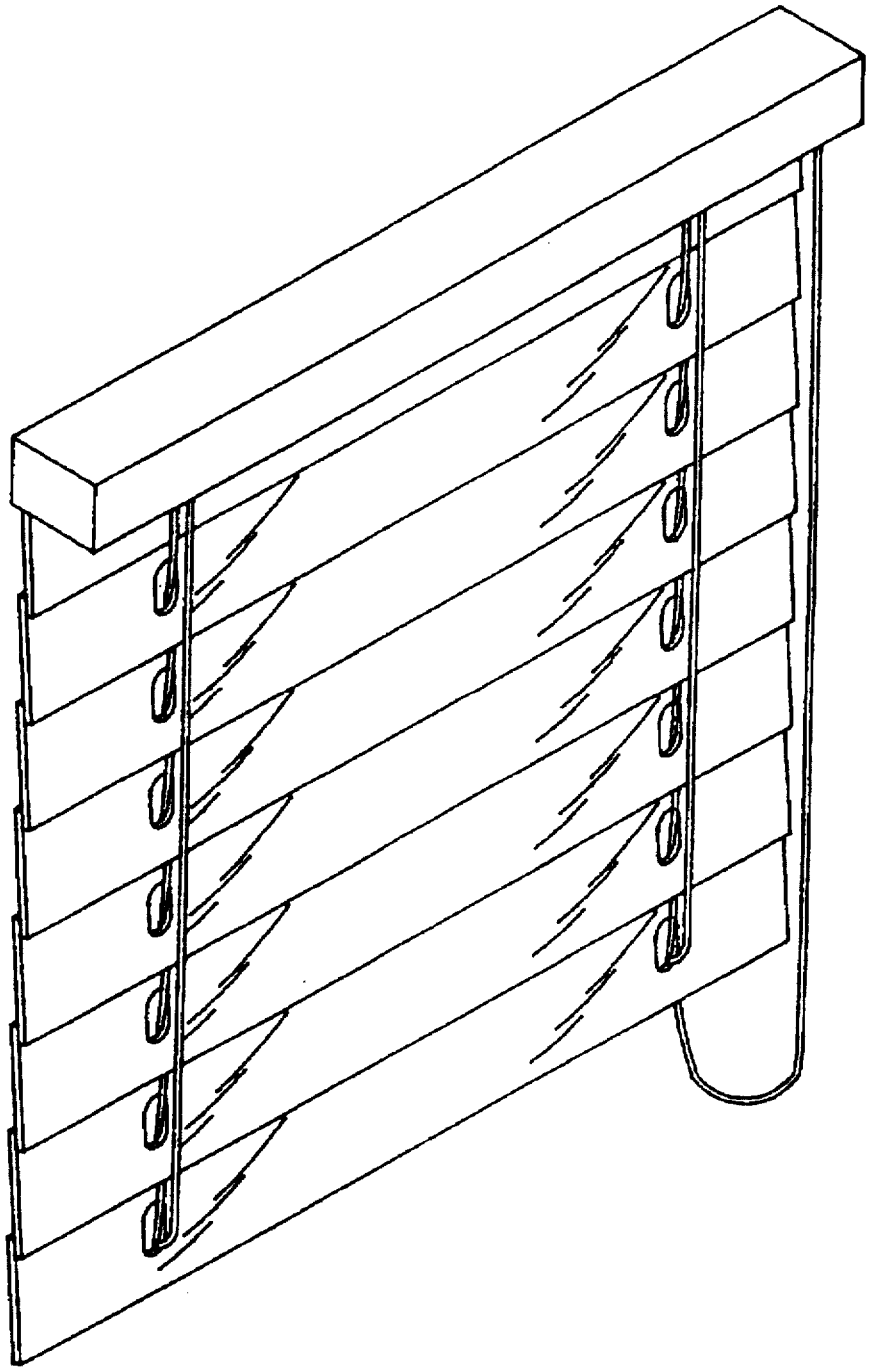
FIG. 10 shows a bamboo blind constructed according to the present invention.

The finished bamboo slats thus obtained are then assembled with a pull cord to form a bamboo blind (see FIG. 10).

What the invention claimed is:

1. A method of fabricating bamboo slats for bamboo blinds, comprising the steps of:

i) cutting bamboo wood selected from a bamboo cane into bamboo strips of a predetermined length;

ii) removing a skin and joints from opposing sides of said bamboo strips and boiling the bamboo strips in a diluted hydrogen peroxide solution for 8 hours to prevent decay;

iii) heat-drying said boiled bamboo strips;

iv) polishing said dried bamboo strips to form fine bamboo strips;

v) coating said fine bamboo strips with a bonding glue;

vi) bonding the glue-coated bamboo strips in longitudinally side by side relationship in a pneumatic press to form a rectangular bamboo plate;

vii) trimming peripheral edges of said rectangular bamboo plate;

viii) polishing said trimmed bamboo plate with a polishing wheel;

ix) splitting said polished bamboo plate into raw bamboo slates having a predetermined thickness;

x) compacting said raw bamboo slats with a pneumatic press;

xi) polishing said compacted bamboo slats with a grinding wheel;

xii) coating said polished bamboo slats with a base coating;

xiii) coating said base coated bamboo slats with a face coating; and xiv) punching two holes through said face coated bamboo slats for insertion of a respective pull cord therethrough when assembled into a bamboo blind.

2. The method of claim 1, wherein the step of bonding includes the step of forming said pate with a thickness within an approximating range of 17–25 mm, and a width within an approximating range of 28–110 mm.

3. The method of claim 1, wherein the step of coating with a face coating provides said face coated bamboo slats with a hardness within an approximating range of 2 H–4 H.

4. The method of claim 1, wherein the step of cutting includes the step of selecting bamboo wood from a bamboo cane having a diameter within an approximating range of 3"~5" and a thickness within an approximating range of 10 mm~26 mm.

5. The method of claim 1, wherein the step of cutting includes the step of cutting said bamboo strips with a width within an approximating range of 20 mm~30 mm.

6. The method of claim 1, wherein the step of heat-drying includes the step of heating said boiled bamboo strips to a temperature within an approximating range of 50°–60° C. for a time period approximating 48 hours.

7. The method of claim 1, wherein the step of coating said fine bamboo strips includes the step of forming said bonding glue by mixing an acrylic powder with a resin.

8. The method of claim 1, wherein the step of splitting includes the step of forming said raw bamboo slats with a thickness within an approximating range of 0.6 mm~2.7 mm.

9. The method of claim 1, wherein the step of coating said polished bamboo slats includes the step of forming said base coating from a digestive fiber, a surfacer and a resin mixture.

10. The method of claim 1, wherein the step of coating said base coated bamboo slats includes the step of forming said face coating from a digestive fiber, a resin, a surfacer and an organic solvent mixture.

* * * * *